United States Patent [19]

F'Geppert

[11] Patent Number: 4,726,788

[45] Date of Patent: Feb. 23, 1988

[54] ELECTRICAL RECEPTACLE

[76] Inventor: Erwin F'Geppert, 27563 Meadowbrook, Novi, Mich. 48050

[21] Appl. No.: 891,808

[22] Filed: Jul. 28, 1986

[51] Int. Cl.[4] ..... H01R 13/74

[52] U.S. Cl. ..... 439/551; 439/271

[58] Field of Search ..... 339/126 R, 126 J, 129, 339/130, 94 A, 94 M, 89 R, 89 M; 439/271, 312, 336, 549, 550, 551

[56] References Cited

U.S. PATENT DOCUMENTS

| | | | |
|---|---|---|---|
| 2,949,642 | 8/1960 | Lieberman | 339/89 M |
| 3,601,769 | 8/1971 | Oliver et al. | 339/94 M X |
| 3,711,815 | 1/1973 | Pierce et al. | 339/90 R |
| 3,998,515 | 12/1976 | Panek | 339/94 A X |
| 4,421,369 | 12/1983 | Myking | 339/94 A X |

*Primary Examiner*—Eugene F. Desmond

[57] ABSTRACT

An electrical receptacle containing a multiple number of pin-type connectors, wherein the receptacle housing is a tubular metal member susceptible to manufacture by low cost screw machine procedures. Most surfaces of the metal member are centered on the tube axis, except that a circular flange on the member has a localized flat surface machined thereon for anti-rotation lock action. The receptacle is designed to be secured in place by a concealed nut for protection against theft or vandalism.

1 Claim, 8 Drawing Figures

ELECTRICAL RECEPTACLE

GOVERNMENT INTEREST

The invention described herein may be manufactured, used, and licensed by or for the Government for governmental purposes without payment to me of any royalty.

BACKGROUND AND SUMMARY OF THE INVENTION

This invention relates to an electrical receptacle wherein electrical pin connectors are encapsulated in an elastomeric plug-like body contained within a tubular metallic housing. The tubular housing is designed to be mounted on the wall of a junction box to enable the pin connectors to transmit electricity to/from componentry within the box and an external cable leading away from the box. The end of the cable is defined by a plug section having a series of hollow (female) connectors therein adapted to fit onto the pin connectors in the electrical receptacle. The cable may be detached from the receptacle.

The invention is visualized as an improvement on an existing electrical receptacle wherein the tubular housing is formed by casting procedures. My receptacle is designed so that the tubular housing can be manufactured out of tubular bar stock by screw machine procedures. A special object of my invention is to reduce the cost of manufacture of the electrical receptacle.

THE DRAWINGS

FIG. 3 is taken on line 3—3 in FIG. 4.

PRIOR ART STRUCTURE

Figure 1:
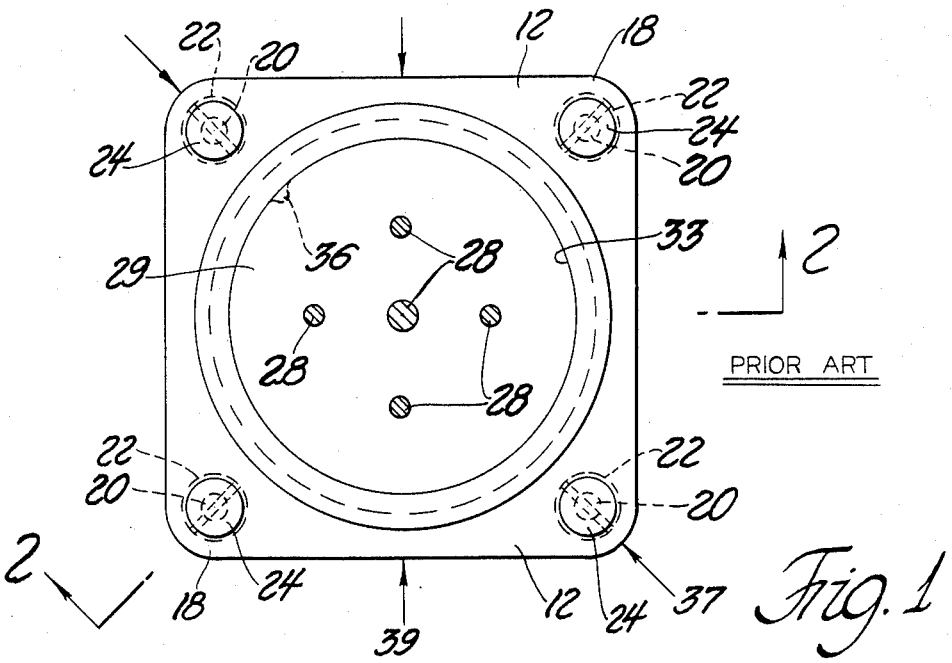
FIG. 1 is a end view of an electrical receptacle constructed according to prior art practice.
Figure 2:
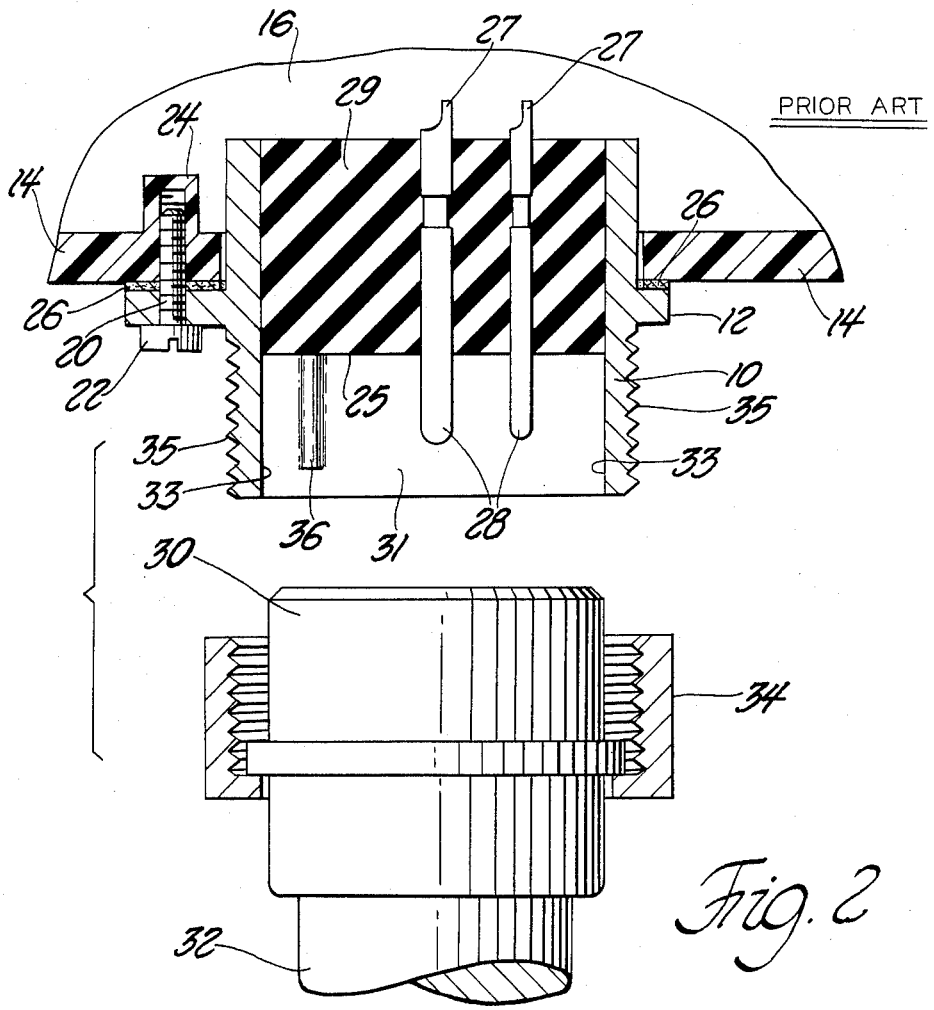
FIG. 2 is a sectional view taken on line 2—2 in FIG. 1.

FIGS. 1 and 2 illustrate a prior art receptacle that was the starting point for my invention. The receptacle includes a tubular metal housing 10 having an outwardly-extending flange 12 designed to mount the receptacle on a wall structure 14. Wall structure 14 could be one wall of a junction box or similar enclosure containing electrical equipment, such as one or more timers, switches, relays, circuit boards, or transformers. The electrical equipment would be located in space 16 behind wall structure 14.

As seen in FIG. 1, flange 12 is of square plan configuration. The four corner areas 18 of the flange have small circular holes 20 drilled therethrough to accommodate the shank portions of screws 22. The screw threads mesh with threads formed in bosses 24 that are molded as integral parts of wall structure 14. An elastomeric gasket 26, having the same configuration as flange 12, is positioned between the flange and the outer surface of wall structure 14.

Pin connectors 28 are located within housing 10 to form electrical connectors between the electrical equipment in space 16 and female contacts contained within an external plug 30. An elastomeric insulator body 29 is molded around pins 28 to retain them in predetermined spaced positions within metal housing 10. End areas 27 of pins 28 are designed to be soldered to non-illustrated wires extended from the electrical equipment within space 16.

External plug 30 is affixed to an electrical cable 32 that has a number of electric lines therein corresponding to the number of pin connectors 28 (one line for each pin connector). Plug 30 is designed for insertion into space 31 within housing 10. The plug is retained in housing space 31 by means of a nut 34 that loosely encircles plug 30. Manual turning force on nut 34 causes the nut to advance along threads 35 on housing 10, to thereby clamp plug 30 in place against surface 25 of elastomeric body 29.

The outer surface of plug 30 may have an axial slot therein registerable with a rib 36 projecting from the inner cylindrical surface 33 of housing 10. The rib-slot arrangement orients plug 30 so that pins 28 connect with the appropriate electrical contacts in the plug.

DISADVANTAGES OF THE PRIOR ART STRUCTURE

The receptacle structure shown in FIGS. 1 and 2 is disadvantageous from a manufacturing cost standpoint in that the square plan configuration of flange 12 requires metal housing 10 to be formed by a casting operation. Housing 10 could be formed more cheaply if it could be made from tubular bar stock, using screw machine operations.

Additional cost is built into the structure of FIGS. 1 and 2, because of the need for the four screws 22, the four molded bosses 24, and the tapped threads in bosses 24. It would be advantageous to eliminate the four screws and associated bosses, to reduce costs and also to reduce the time required to install or remove the receptacle.

The square plan configuration of flange 12 is a disadvantage in that the diagonal dimension 37 across the flange corners is appreciably greater than the minimum diametrical dimension 39 across the space between opposite side surfaces of the flange. In some cases the large diagonal dimension 37 would be too great for proper mounting of the receptacle on wall structure 14, due to lack of sufficient unencumbered surface area on structure 14.

In the interest of mounting flexibility (versatility), it would be desirable to eliminate the square corners 18 on flange 12.

The square plan configuration of flange 12 is also disadvantageous from the sealing standpoint. The square corner areas on loose gasket 26 may not always seat flat against flange 12 and/or the surface of wall structure 14. The loose gasket 26 material can bunch up around one or more of screws 22 or the associated holes, thereby slightly tilting flange 12 out of position, to the extent where the seal is destroyed at some point around the receptacle periphery. Flatness of wall structure 14 is another factor affecting seal reliability; the large diagonal dimension 37 (FIG. 1) increases the surface area required to be flat. A more reliable seal would be possible if the sealing surfaces cold be circular (in plan) rather than square.

THE INVENTION

Figure 3:
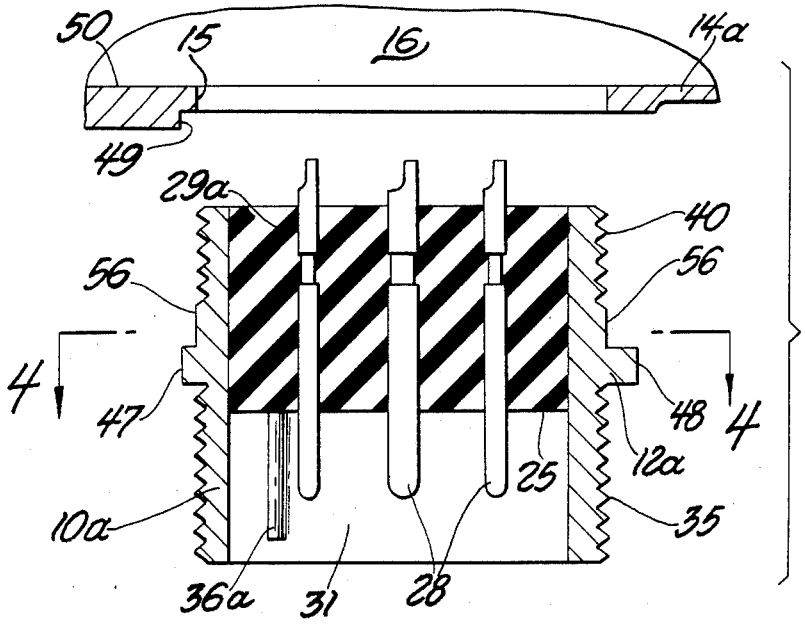
FIG. 3 is a sectional view taken through an electrical receptacle constructed according to my invention.
Figure 4:
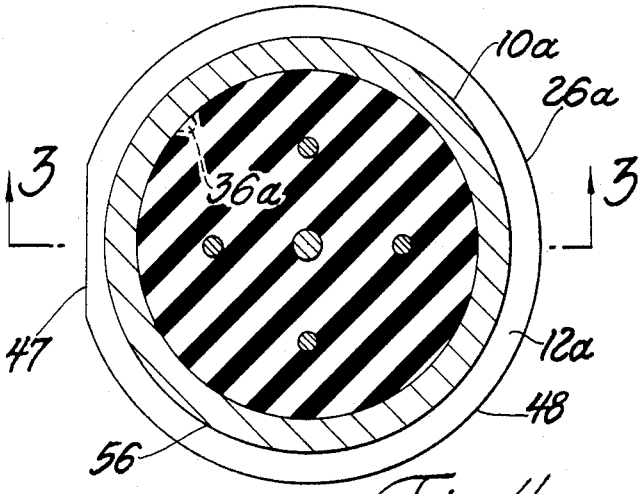
FIG. 4 is a sectional view taken on line 4—4 in FIG. 3.
Figure 5:
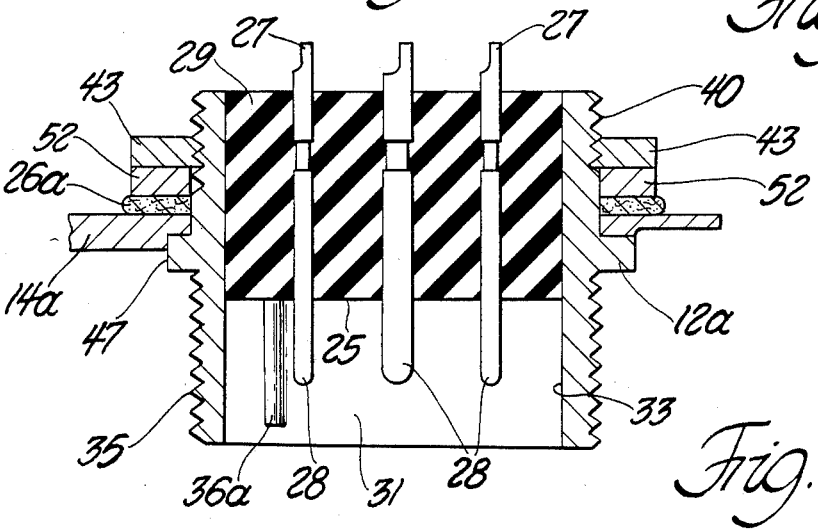
FIG. 5 is a sectional view taken in the same direction as FIG. 3, but showing the electrical receptacle installed on a support wall.

FIGS. 3 through 5 illustrate one form that my invention can take. As shown in FIG. 3, the metal housing 10a has a flange 12a radiating outwardly relative to cylindrical surface 56 and threaded housing areas 35 and 40. In plan configuration (FIG. 4) flange 12a is circular (for the most part), rather than square as in the case of FIG. 1. A flat surface 47 is machined into the otherwise circular surface 48 of the flange.

Pin connectors 28 may be located within housing 10a by means of a molded elastomeric body 29a. The elastomeric molding preferably includes a rib 36a extending along the inner surface 33 of housing 10a to perform the function achieved by aforementioned rib 36 (FIG. 2).

The stationary wall structure 14a is a generally flat structure devoid of the bosses 24 that are used in the prior art arrangement of FIG. 2. Wall structure 14a has a large circular opening 15 therethrough designed to freely, but snugly, accommodate housing 10a, as shown in FIG. 5. A nut 43 is threaded onto threaded wall area 40 of housing 10a to retain the receptacle in place on wall structure 14a. A washer 52 and elastomeric gasket 26a are interposed between nut 43 and the inner face of enclosure wall 14a. Washer 52 and gasket 26a can be bonded together or separately formed and positioned.

Preferably some means is provided to prevent the receptacle from rotating in opening 15. One low cost anti-rotation mechanism is shown in the drawings. The The mechanism includes the aforementioned flat surface 47 on flange 12a and a mating shoulder 49 formed on wall structure 14a. When nut 43 is tightened on washer 52, surface 47 abuts shoulder 49 to prevent rotation of the receptacle.

Wall structure 14a has an interior flat surface 50 engageable with the face of gasket 26a to form a fluid tight seal. Preferably surface 50 is smooth and flat, e.g. root mean square 125 or smoother. Also, cylindrical surface 56 has a snug fit in opening 15 and the edge of the gasket opening, whereby the clamp force of nut 43 causes the inner edge of elastomeric gasket to be expanded radially inward into sealable engagement with cylindrical surface 56. A relatively tight fluid seal is formed between gasket 26a and surfaces 50 and 56.

Figure 6:
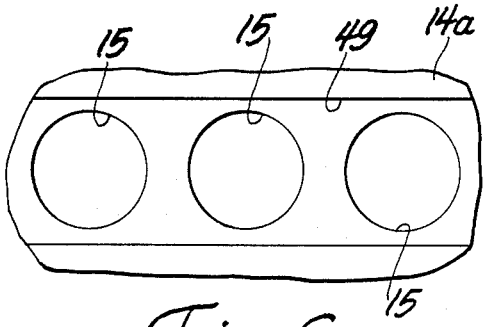
FIG. 6 illustrates a hole arrangement for mounting a plural number of electrical receptacles constructed according to FIG. 3.

In some cases the junction box is designed to mount more than one electrical receptable on its wall 14a. In that event the various openings 15 (one for each receptacle) are arranged alongside one another in row-like fashion. Shoulder 49 spans the multiple openings 15 to form an anti-rotation surface for all receptacles in the row. FIG. 6 illustrates the contemplated arrangement.

FIGS. 7 AND 8

Figure 7:
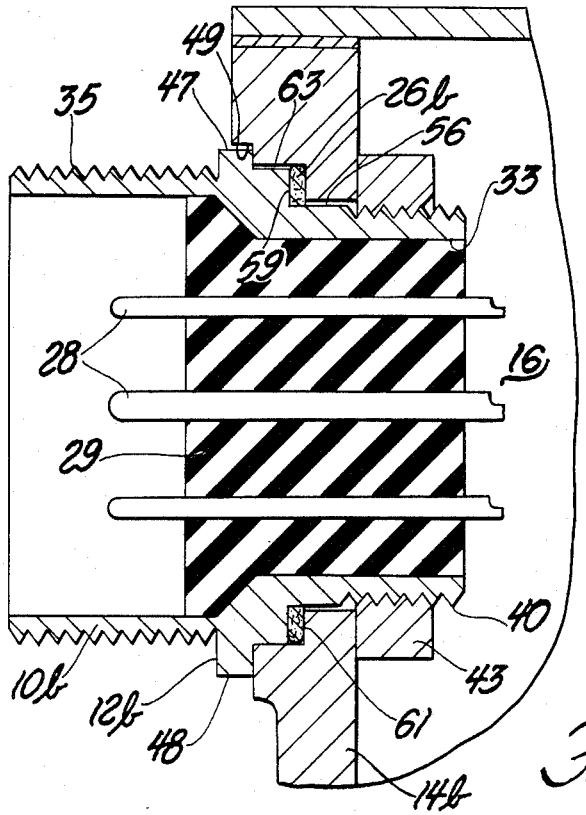
FIG. 7 is a sectional view taken through another embodiment of my invention.
Figure 8:
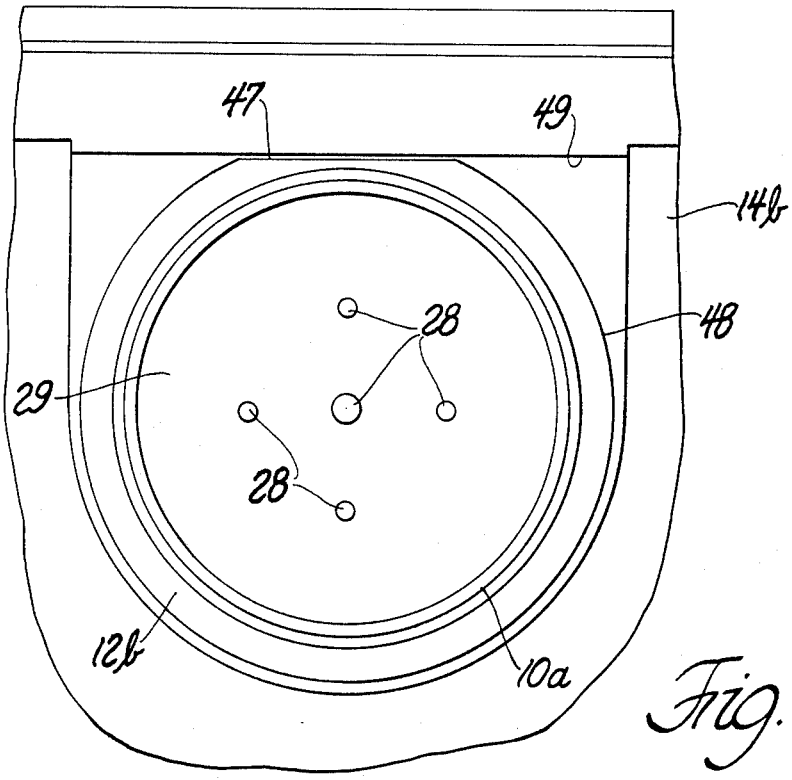
FIG. 8 is an end view of the FIG. 7 structure.

FIGS. 7 and 8 illustrate a second form that my invention can take. In this case the tubular housing 10b has a generally circular flange 12b whose outer edge 48 is generally circular in plan outline, except for a flat surface 47. Enclosure wall 14b is formed with a shoulder 49 adapted to abut surface 47 when nut 43 is threaded onto threaded area 40 of the tubular housing.

Tubular housing 10b has a central cylindrical section sized to freely fit into a cylindrical counterbore 63 formed in housing wall 14b. An elastomeric gasket 26b is interposed between radial surface 59 on housing 10b and radial surface 61 defined by counterbore 63. Gasket 26b can be a loose part installable in the counterbore prior to insertion of housing 10b into circular opening 56 in wall 14b. Alternately, gasket 26b can be bonded to surface 59, in which case the gasket is automatically positioned in its operative location as part of the process of inserting housing 10b into opening 56. Nut 43 is threaded onto the metal housing after the housing is in its installed position.

ADVANTAGES OF THE INVENTION

Principal advantages of the structures shown in FIGS. 3 through 5 and 7 through 8 are low manufacturing costs. Housings 10a and 10b can be formed from tubular bar stock by screw machine operations. Flange 12a (or 12b) has a circular major diameter corresponding to the diameter of the raw bar stock used to form housing 10a (or 10b). The tubular bar stock can have an internal diameter sufficient to form housing surface 33.

Housing 10a (or 10b) can be machined to final shape in a conventional "screw machine" type cutting machine comprised of a work-support structure designed to support a number of work pieces in a radial array. The support structure is indexed rotatably on a vertical axis so that each work piece advances through a series of cutting stations. The cutting machine includes a cut-off tool at the first station to define the housing length. At each station, a different cutting operation is performed on a partially-formed work piece. Each work piece is discharged from the last station in its final configuration. Manufacturing costs are relatively low, appreciably lower than the cost to make housing 10 under prior art practice (FIGS. 1 and 2).

The arrangements of FIGS. 3 through 5 and 7 through 8 also are advantageous in that they avoid the need for internal bosses 24 (FIG. 2). In each case flat surface 47 provides the anti-rotation action achieved by the boss-screw arrangements of FIGS. 1 and 2.

The proposed structures also have "anti-vandalism" advantages, due to the fact that in each case nut 43 is located on the inside of the junction box. This is in contrast to the arrangement of FIGS. 1 and 2 wherein screws 22 are accessible from outside the junction box. The prior art arrangement is subject to vandalism, theft or sabotage, whereas the structures of FIGS. 3 through 5 and 7 through 8 are not.

Ordinarily, the junction box is painted on its outer surface, but not on its inner surface. With the arrangement of FIGS. 3 through 5, the gasket seats on the inner (unpainted) surface of the junction box; the unpainted surface can be made relatively smooth, whereas the painted (outer) surface of the box is relatively rough, such that it would be difficult to achieve a fluid tight seal thereon. Under prior art practice, the seal-engageable portions of the box are masked during the box-painting operation (in order to provide a satisfactory seal). The arrangement of FIGS. 3 through 5 avoids the need for masking.

The arrangement of FIGS. 7 and 8 requires paint masking on the outer surface of the junction box. However, the surface to be masked (surface 61) is recessed within a counterbore, that can be masked rather easily with a circular disc mask (not shown).

At the time of making this invention, it was thought that the arrangement of FIGS. 1 and 2 represented the closest prior art. More recently, U.S. Pat. No. 3,711,815 to Pierce et.al. was discovered; the patent shows an electrical receptacle 13 that includes a metal housing held on a wall structure 14 by a nut 16. The housing structure shown in U.S. Pat. No. 3,711,815 can probably be formed by screw machine cutting operations at relatively low cost. Therefore, the patented structure is probably a closer approximation of my invention than the structure shown in attached FIGS. 1 and 2. The arrangement in U.S. Pat. No. 3,711,815 does not include the "anti-vandalism" or "anti-rotation" advantages possessed by my improved arrangement. My proposed structure is believed to be an improvement on the structure disclosed in U.S. Pat. No. 3,711,815.

I wish it to be understood that I do not desire to be limited to the exact details of construction shown and described for obvious modifications will occur to a person skilled in the art, without departing from the spirit and scope of the appended claims.

I claim:

1. In combination: an electrical equipment enclosure comprising a wall (14*b*) defining an external face and an internal face; said enclosure wall having a circular opening therethrough, said circular opening including a cylindrical counterbore (63) defining a radial surface (61) facing the zone outside the equipment enclosure; said enclosure wall (14*b*) being configured to define a flat upstanding shoulder surface (49) on its external face in close adjacency to the cylindrical counterbore; and electrical receptacle adapted to fit into the circular opening in the enclosure wall to provide an electrical connection between the associated electrical equipment and an exterior plug-cable unit; said electrical receptacle comprising a one piece tubular wall (10*b*) having a circular flange (12*b*) radiating outwardly therefrom at an intermediate point therealong to seat against the aforementioned external face of said enclosure wall (14*b*); said circular flange (12*b*) having a localized flat edge surface (47) at one point therearound adapted to abut against said upstanding shoulder surface (49) to preclude rotation of the receptacle in the circular opening; said one piece tubular wall having a central cylindrical section sized to fit into said cylindrical counterbore (63); said cylindrical section defining a flat radial surface (59) in opposing relation to the aforementioned radial surface (61) when the electrical receptacle is installed on the equipment enclosure; an annular gasket (26*b*) interposed between said two radial surfaces to seal the annular joint between said tubular wall and circular opening; a plural number of electrical pin connectors (28) within the space circumscribed by the tubular wall; an elastomeric material molded within the tubular wall around the pin connectors to operatively locate said pin connectors for engagement with electrical contacts within the aforementioned plug-cable unit; said tubular wall having a first end area (40) locatable within the equipment enclosure, and a second end area (35) locatable outside the equipment enclosure; each said end area having screw threads formed thereon; and a nut (43) threadable on the first end area threads within the equipment enclosure to clamp the receptacle in place on said enclosure wall (14*b*); said nut being inaccessible from points outside the equipment enclosure; said circular flange (12*b*) having a radial dimension that is comparable to the wall thickness of each end area (35 or 40) whereby the major diameter of the electrical receptacle is only slightly greater than the diameter measured across the first end area of the tubular wall.

* * * * *